United States Patent [19]

Reda

[11] 4,090,706

[45] May 23, 1978

[54] BELT TENSION EXERCISER

[75] Inventor: Ronald J. Reda, Mt. Kisco, N.Y.

[73] Assignee: Reda Exercisers, Inc., Mt. Kisco, N.Y.

[21] Appl. No.: 735,507

[22] Filed: Oct. 26, 1976

[51] Int. Cl.[2] ..... A63B 21/02

[52] U.S. Cl. ..... 272/137; 272/142; 272/143

[58] Field of Search ..... 272/137, 138, 139, 125, 272/126, 142, 143, 75; 128/69

[56] References Cited

U.S. PATENT DOCUMENTS

| | | | |
|---|---|---|---|
| 904,339 | 11/1908 | Lievre | 272/137 |
| 2,280,274 | 4/1942 | Wildermuth | 128/69 |
| 2,461,682 | 2/1949 | OeFferrari | 272/142 |
| 2,590,951 | 4/1952 | Farison | 272/142 |
| 3,204,955 | 9/1965 | Quire et al | 272/125 |
| 3,655,185 | 4/1972 | Kane | 272/137 |

FOREIGN PATENT DOCUMENTS

| | | | |
|---|---|---|---|
| 1,211,130 | 11/1970 | United Kingdom | 272/74 |

*Primary Examiner*—William R. Browne

[57] ABSTRACT

A belt tension exerciser is provided with a rigid transverse handle which is longitudinally connected to an elastic band or belt to form a closed loop. The effective diameter of the loop measured in the direction of an exercising force may be changed thereby to adjust the expansion tension in the belt. The handle may be turned on its axis relative to the belt to permit a variety of exercise movements without adjusting one's grip.

2 Claims, 3 Drawing Figures

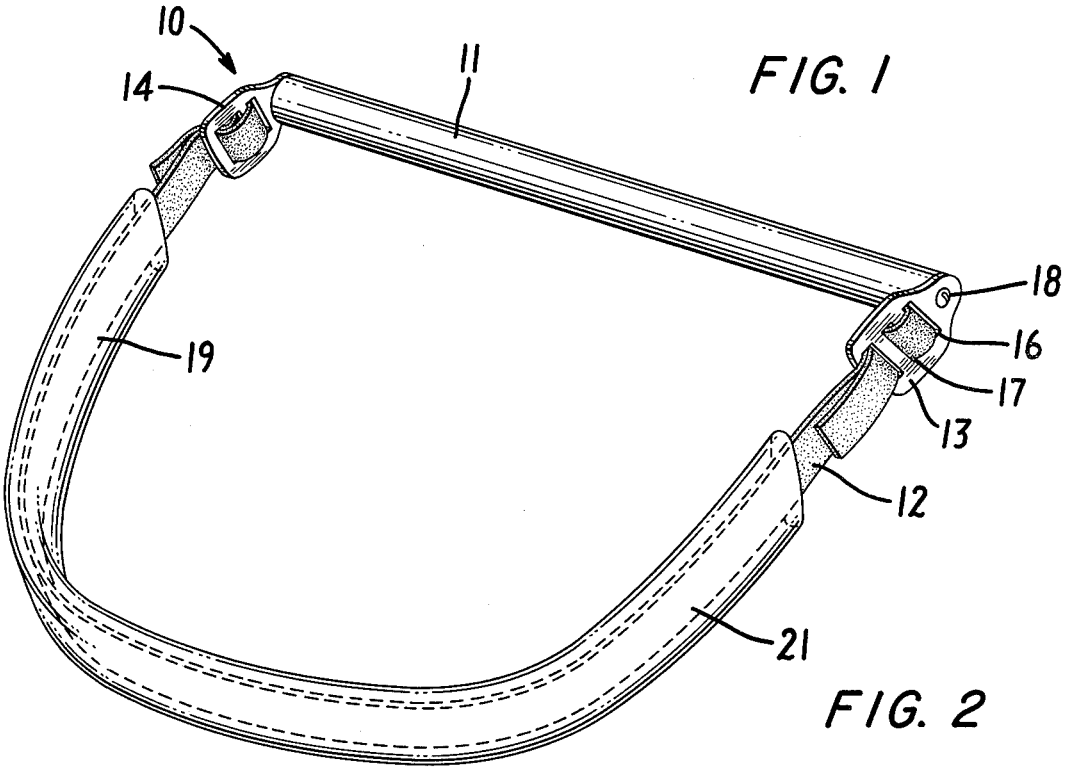
FIG. 1
FIG. 2
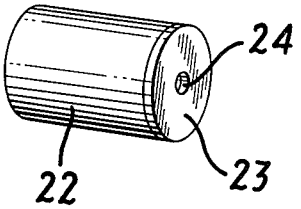
FIG. 3
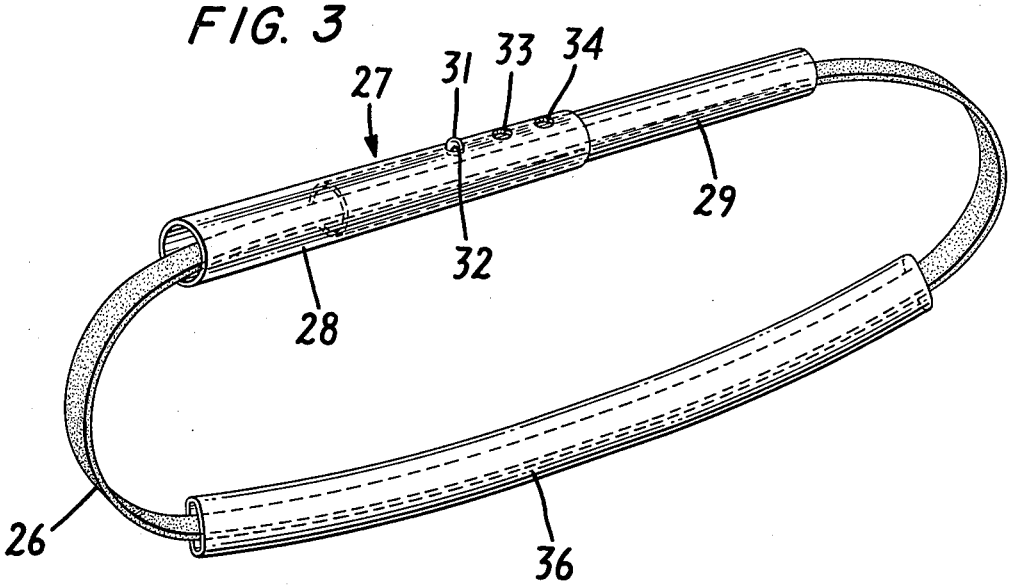

BELT TENSION EXERCISER

BACKGROUND OF THE INVENTION

Heretofore, belt tension exercising devices have been intended primarily for use in exercising the arm and chest muscles. In many prior devices, an elastic band is connected to a pair of hand grips which are pressed in opposite directions to stretch the elastic for exercise. These prior devices are severely limited as to the exercises which may be performed and thereby limit the number of muscles of the body which may be exercised. Moreover, previous exercise devices have experienced unduly swift deterioration in the interconnection between the elastic material and the handles. Such deterioration often results in a dangerous condition in which sudden severance of the connection during an exercise can produce an injury.

In contrast, the present invention permits exercising, not only the arm and chest muscles in the conventional way, but the upper and lower back, shoulders, calves, thighs, hips and stomach. The tension in the elastic band is adjustable thereby permitting more advanced exercises as body conditioning improves. Moreover, the points of contact between the elastic and the handle are arranged for minimal wear and tear and thereby reduce the danger of a sudden severance of the elastic.

SUMMARY OF THE INVENTION

The exerciser of the present invention is operable in the form of a closed loop adapted for encirclement of a portion of the user's body. The exerciser consists of a longitudinally expandable preferably rubber band which longitudinally engages a rigid handle. The interconnection between the handle and the elastic band permits the former to turn on its axis relative to the latter. The effective length of the relaxed band may be adjusted to effect a change in the expansion tension. Exercises are performed by pressing the handle radially outwardly to stretch the elastic band. Since the handle may be turned relative to the band, and since the effective length of the band is adjustable, the present exerciser may be used for a variety of exercises which have heretofore been impossible with the prior type of exercising device.

BRIEF DESCRIPTION OF THE DRAWINGS

For a further understanding of the present invention, a reference may be had to the accompanying drawings, in which:

FIG. 1 is a perspective view of an exerciser in accordance with the present invention;

FIG. 2 is a perspective view of a portion of the exerciser handle adapted for use in the preferred embodiment; and FIG. 3 is a perspective view of another embodiment of the present invention.

BRIEF DESCRIPTION OF THE PREFERRED EMBODIMENTS

Referring now to the drawings, and in particular to FIG. 1, there is shown an exerciser 10 having a rigid transverse handle member 11, releasably connected between the ends of a length or band of longitudinally expandable elastic material 12. A pair of swivel fasteners in the form of buckles or clasps 13 and 14 interconnect each end of the handle 11 with the elastic material 12. The clasps may be conventional buckles having a pair of parallel and laterally extending slots 16 and 17 through which the elastic material 12 is threaded into the customary reverse loop interlock. The effective length of the elastic material extending between ends of the handle may thereby be manually adjusted for the particular exercise performed.

The buckles 13 and 14 are preferably pivotally connected to the handle 11. Any suitable pivot mount may be utilized for this purpose. In the present embodiment, each of the buckles 13 and 14 is simply connected to the handle by way of self-tapping screw 18.

Extruded gum rubber has been found to be a particularly effective material for the elastic band 12. The band of rubber is preferably provided with rounded edges to minimize chafing of the body during exercise movements. By way of example, the rubber band may be 48 inches long, $1\frac{1}{8}$ inches wide and $\frac{1}{8}$ inch thick. It should be noted that while extruded gum rubber of the foregoing dimensions has been found particularly useful, any longitudinally expandable elastic material may also be utilized without departing from the scope of this invention.

Where rubber is used for the elastic band, it is desirable to cover that portion of the band which is intended to contact the body while an exercise is being performed. Any relatively soft pliable material might be affixed so as to cover the inner surface 19 of the band for this purpose. For example, a length of padding might be tied to the rubber band. In the present embodiment, a portion of the rubber band is enclosed within a soft pliable sleeve 21. The sleeve may be of any appropriate material, such as leather, which will permit the enclosed rubber band to expand and contract without binding. If desired, the sleeve might be exteriorly padded along the surface facing the handle further to protect the user's body during an exercise. It has been found that where the sleeve is approximately 30 to 36 inches in length, it is sufficiently comfortably to protect the user against chafing for most of the exercises which may be performed with this device. However, a longer or shorter sleeve may be used without departing from the scope of the invention. Moreover, other appropriate safeguards may be employed by persons skilled in this art, and the present invention is not to be limited to any particular protective arrangement.

The handle 11 may be in the form of a solid wooden dowel of substantially circular cross section. However, it may also be formed from extruded aluminum in the form of a hollow cylinder. In that case the ends of the cylinder may be closed by way of a pair of cuplike inserts 22, illustrated in FIG. 2. The inserts may be molded of plastic and are formed with a flat base portion 23 having an opening 24 substantially at the center for receiving one of the self-tapping screws 18. When the inserts are assembled to the handle, the base portion 23 faces outwardly and is substantially flush with the end of the handle. Other arrangements for rotatably mounting the buckles 13 to the handle may be used without departing from the invention. The basic advantage is that the handle turns on its axis relative to the elastic band during an exercise. Certain types of exercises are thereby more easily performed. Moreover, there is less wear and tear on the elastic band and accordingly, less opportunity for a weak spot to develop which might subsequently burst and result in injury to the user. Rotatable snaps and other pivot mounts might also be used to interconnect the band and handle. They must, of course, be sufficiently strong to remain engaged when an exercising tension is induced during an exercise.

Referring now to FIG. 3, there is illustrated an alternate embodiment of the present invention. In this embodiment the elastic material 26 forms an endless loop. As in the previous embodiment, it is preferable to utilize extruded gum rubber as the elastic material. The handle 27 is formed from a pair of concentrically interconnected handle units 28 and 29. Each of these units encircles the continuous rubber band 26. Surface friction at the points of contact between the handle units and the band may be reduced by applying a low friction coating to the exterior band and interior handle surfaces.

Adjacent ends of the handle are formed for longitudinally adjustable mutual engagement. Where each unit is a hollow cylinder, the adjacent ends may be of different diameters so that one unit fits concentrically within the other to form a rigid and substantially continuous handle. The inner unit may also be provided with a radially outwardly extending spring loaded bead 31 which passes through a corresponding opening 32 in the overlying outer unit in order to lock the units together.

A plurality of such openings 32–34 may be provided longitudinally aligned on the overlying unit to permit the units to be telescopically adjustable in their longitudinal direction. The length of the handle 27 is thereby changed simply by sliding the units relative to one another until the bead 31 passes through a selected one of the corresponding openings to lock the units in position.

As a feature of this embodiment, the handle units 28 and 29 may be separated and moved to relatively diametrically opposed positions along the elastic band. In these positions the units are separately gripped by each hand. Exercises might thereby be performed which require the elastic band to be flexed by moving the hands in generally opposite directions. Accordingly, the scope of exercises which may be performed with the present exerciser is considerably greater than with the prior devices.

In general, the exercises are performed by anchoring the elastic band around a portion of the body and pressing the handle radially outwardly to a fixed point. For example, a typical upper arm exercise might be performed by placing the band around the upper back, gripping the handle with the hands and pressing the handle outwardly with the arms as far as possible. Assuming maximum arm extension, the distance between the back and the hands is fixed by the body dimensions. The actual force required to be exerted by the arms to accomplish this result will vary inversely with the relaxed diameter of device, measured in the direction of arm extension. Accordingly, in order to induce greater resistance in the exercise to accommodate increasing arm strength, the present invention provides means for adjusting the relaxed diameter of the device.

As described above in connection with FIG. 1, the effective length of the elastic band, as measured between the ends of the handle, may be adjusted by way of the releasable buckles 13 and 14. Alternatively, the same effective band length can be altered by changing the length of the handle. For example, in the arrangement shown in FIG. 3, the concentric handle units 28 and 29 may be telescoped to their different relative longitudinal positions thereby effectively altering the relaxed diameter of the device. When the handle 27 is lengthened, the length of band between the handle ends is shortened and the relaxed diameter of the elastic loop is therefore reduced. Accordingly, the force required to stretch the loop radially outwardly to a given stretched diameter during an exercise is correspondingly increased. Conversely, when the handle is shortened, the relaxed loop diameter is lengthened and the required exercising force is decreased. Such an arrangement provides utility not heretofore available in flexing exercisers.

Where desired, the rubber band 26 may be provided with an appropriate padding 36 which generally corresponds to the padded sleeve 19 of the embodiment of FIG. 1. The padding 36 may be in the form of a sleeve or otherwise connected to the band in such a way as not to bind the elastic during expansion and contraction. As mentioned above, the padding may be fixed or removable, as desired.

Other modifications of the present device will be envisioned by persons skilled in the art. For example, the handle elements 28 and 29 may each be pivotally connected to one end of the elastic band in the manner illustrated in FIG. 1. Accordingly, the scope of the present invention is not to be limited except in accordance with the following claims.

What is claimed is:

1. An exerciser operable as a closed loop formed by a longitudinally expandable elastic band which engages a rigid handle member, the improvement comprising means for adjusting the length of band between the ends of the handle to effect a change in the force required to expand the band radially outwardly during a selected exercise, the handle being rotatable on its axis relative to the band and comprising a pair of separable concentric hollow cylinders slidably engageable one within the other for longitudinal movement back and forth in one direction to effect a change in the length of the handle.

2. The exerciser of claim 1 in which the elastic band comprises an endless belt which passes longitudinally through each of the concentric hollow cylinders of the handle.

* * * * *